United States Patent [19]

Bradbury

[11] Patent Number: 4,745,691

[45] Date of Patent: May 24, 1988

[54] MEANS AND METHODS FOR DRYING SLUDGE

[75] Inventor: Christopher G. Bradbury, Cumberland, R.I.

[73] Assignee: Systems Engineering and Manufacturing Corp., Stoughton, Mass.

[21] Appl. No.: 28,245

[22] Filed: Mar. 20, 1987

[51] Int. Cl.[4] ..... F26B 3/22

[52] U.S. Cl. ..... 34/11; 34/39; 34/180; 34/183

[58] Field of Search ..... 34/183, 182, 180, 39, 34/40; 34/11

[56] References Cited

U.S. PATENT DOCUMENTS

| | | | |
|---|---|---|---|
| 1,489,702 | 4/1924 | Hare | 34/183 |
| 4,010,552 | 3/1977 | Peterson | 34/180 |
| 4,337,583 | 7/1982 | Harris | 34/180 |
| 4,453,319 | 6/1984 | Morris | 34/183 |

*Primary Examiner*—Larry I. Schwartz

*Attorney, Agent, or Firm*—Wolf, Greenfield & Sacks

[57] ABSTRACT

A sludge drier for removing water from sludge has a plurality of augers functionally interconnected to provide a continuous closed loop path of movement to the sludge through an area for drying. The drying area comprises a heated surface with a means for removing dried sludge from the heated surface after drying is carried out.

17 Claims, 3 Drawing Sheets

MEANS AND METHODS FOR DRYING SLUDGE

BACKGROUND OF THE INVENTION

Many metal finishing and printed circuit board operations produce large amounts of waste water which contain heavy metals wastes. These wastes are produced as a bi product of the metal finishing and printed circuit board industries which employ acid and caustic solutions to form hydroxides and other complexes. Several methods for disposing of the waste water are used including treating such waste water in conventional filter presses to remove water and concentrate the solids and thereby reduce the bulk of the material. Filter presses often obtain 25 to 30 percent by weight solids in such metal finishing waste waters. Such filter presses are often disposed in frames three feet or so above a working surface and then unloaded after dewatering into troths or bins placed under the filter presses for removal to further processing or disposal areas.

A known filter press as described above is produced by JWI, Inc. of Holland, Mich. under the tradename J PRESS and is suggested for use with dumpsters or drum disposal systems for removal of treated cakes often containing up to 30 percent solids.

Sludge driers have been used in the past but often have limitations as to drying time, capacity, ease of use or the like.

SUMMARY OF THE INVENTION

It is an object of this invention to provide an effective sludge drier for continuously moving sludge over a heated surface to maximize drying in limited times.

Another object of this invention is to provide a method of effectively breaking up and drying sludge using a sludge drier in accordance with the proceeding object.

Still another object of this invention is to provide a plurality of augers functionally interconnected to provide a continuous loop path of movement to sludge through a drying area to effectively dry sludge and remove moisture therefrom in minimized time periods.

According to the invention, a sludge drier useful for removing water from sludge obtained from waste water treatment, has a plurality of augers functionally interconnected to provide a continuous closed loop path of movement to the sludge through an area for drying. A heated surface is positioned near the augers and lies in the path of movement of the sludge to provide heat to the sludge to remove water therefrom as the sludge moves over the path. Means are provided for removing moisture from the area as in the form of an exhaust blower. An auger or other means is provided for removing dried sludge from the drier after drying is carried out.

In a preferred embodiment of a method of this invention, the drier described above is used. Sludge obtained from a filter press is introduced into the drier and the auger is activated to move the sludge within a path of travel. The original sludge can have a moisture content of up to 30 percent solids and after movement in a closed loop at a temperature in the range of from about 150° F. to about 275° F. for periods of from two to eight hours, the solids content can be over 70 percent whereupon the sludge can be removed from the drier. Preferably the augers are ribbon flighted augers having kickers to provide the continuous path of movement and to shear the sludge cakes.

It is a feature of this invention that the sludge drier apparatus can be made compact to fit under conventional filter presses and receive a filter press cake as it drops from the press on emptying. Thus, the drier of this invention can be 24 to 30 inches in height for example. The driers avoid the use of tote bins and the like to transfer sludge since they can receive the sludge directly from the filter press. This feature also provides for ease of handling and reduces operator contact with sludge while saving floor space. Because parallel augers are used, mixing and turbulence is created over the bottom surface under which driers can be located, thus avoiding hot spots which could vaporize toxic materials. Uniform temperature flat surfaces can be used as the actual drying surface. When ribbon augers are used, they act to cut and blend as well as convey. It is a feature of this invention that a discharge auger can be used to raise the level of the dried sludge for dispersion by gravity to packing barrels and the like; however, other discharge means can be used.

DESCRIPTION OF THE DRAWINGS

The above and other objects, features and advantages of the present invention will be better understood from the accompanying drawings in which.

BRIEF DESCRIPTION OF PREFERRED EMBODIMENTS

With reference now to the drawings, a preferred embodiment of the sludge drier of this invention useful for removing water from sludge obtained from waste water treatment is shown generally at 10. The sludge drier has a conveyer section designated generally at 11 mounted within a trough 12 having a cover 13 and means 14 for removing dried sludge after drying is carried out.

Preferably all parts are made of stainless steel or epoxy coated carbon steel if in contact with the sludge during processing.

Figure 1:
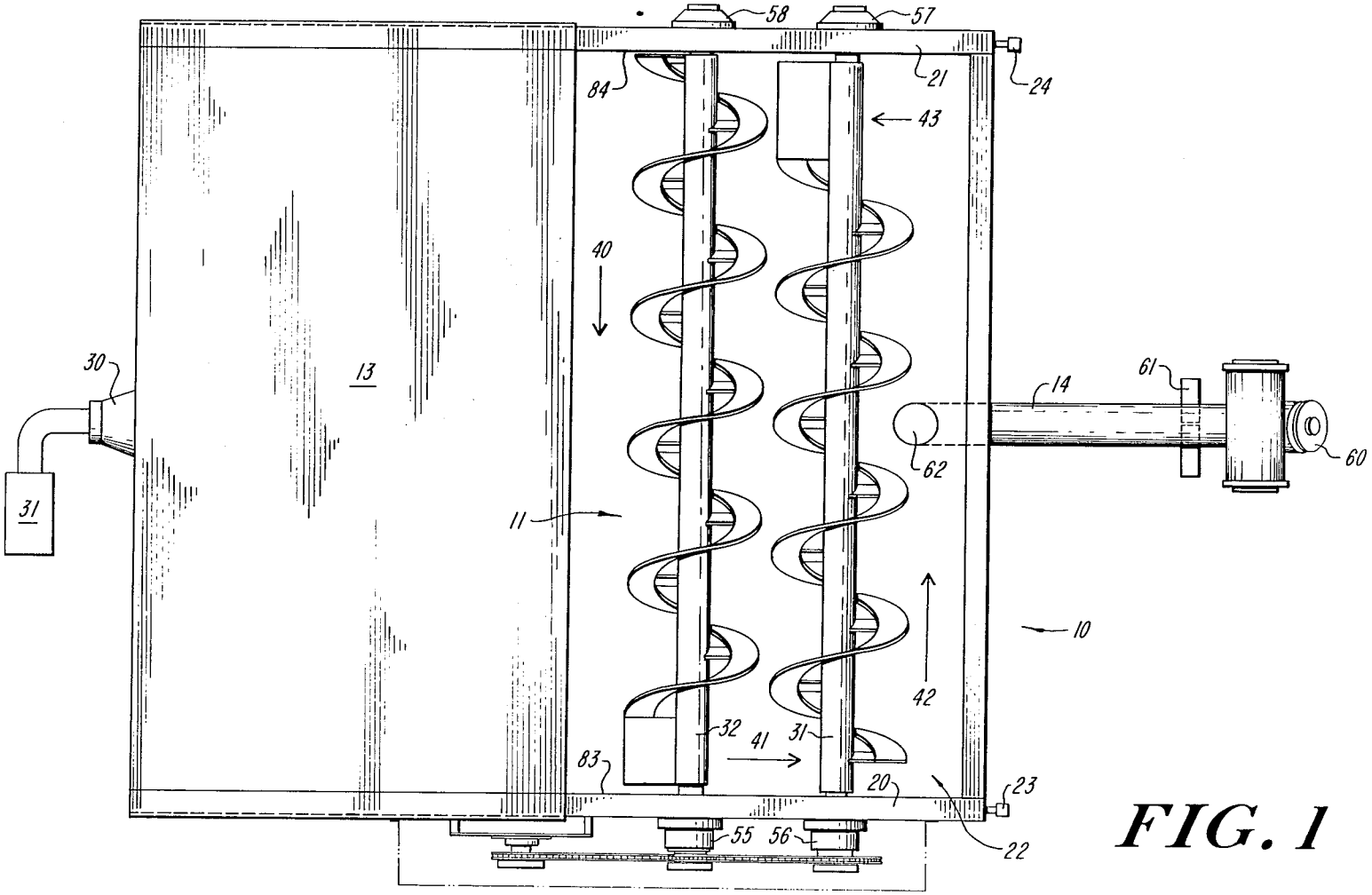
FIG. 1 is a top plane view of a sludge drier in accordance with a preferred embodiment of this invention.
Figure 2:
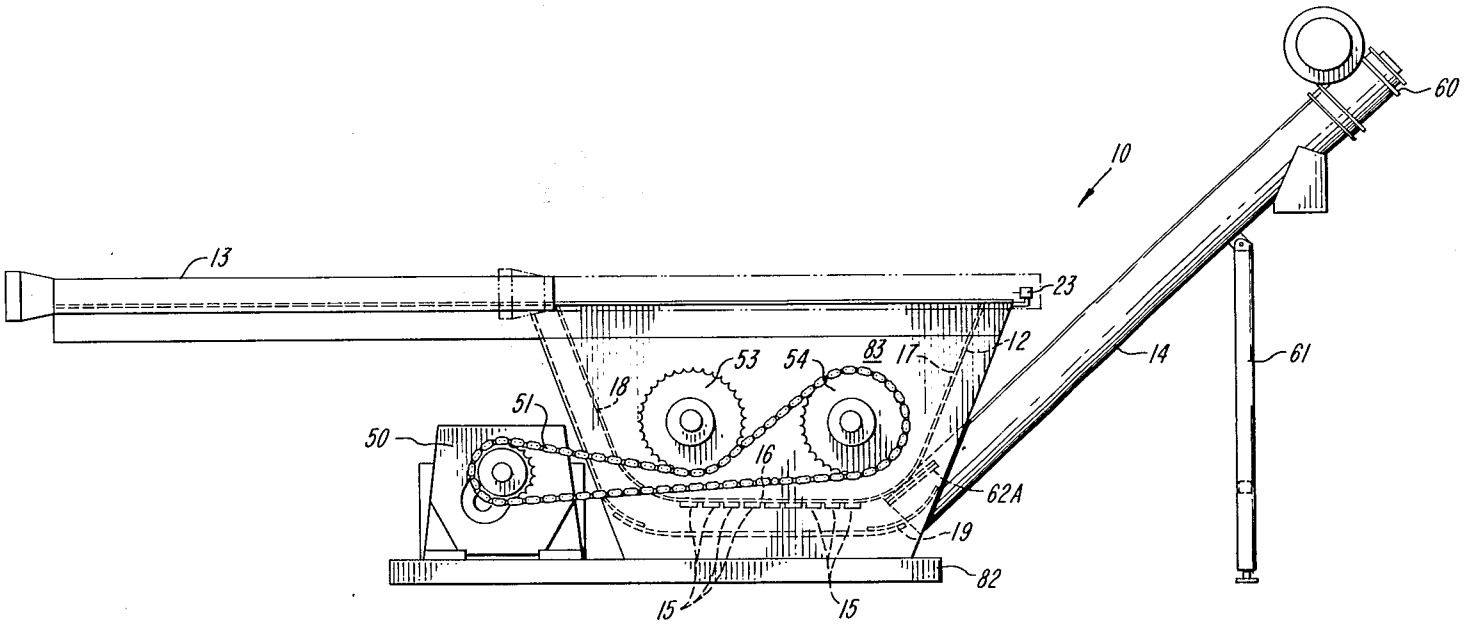
FIG. 2 is a right side view thereof.
Figure 3:
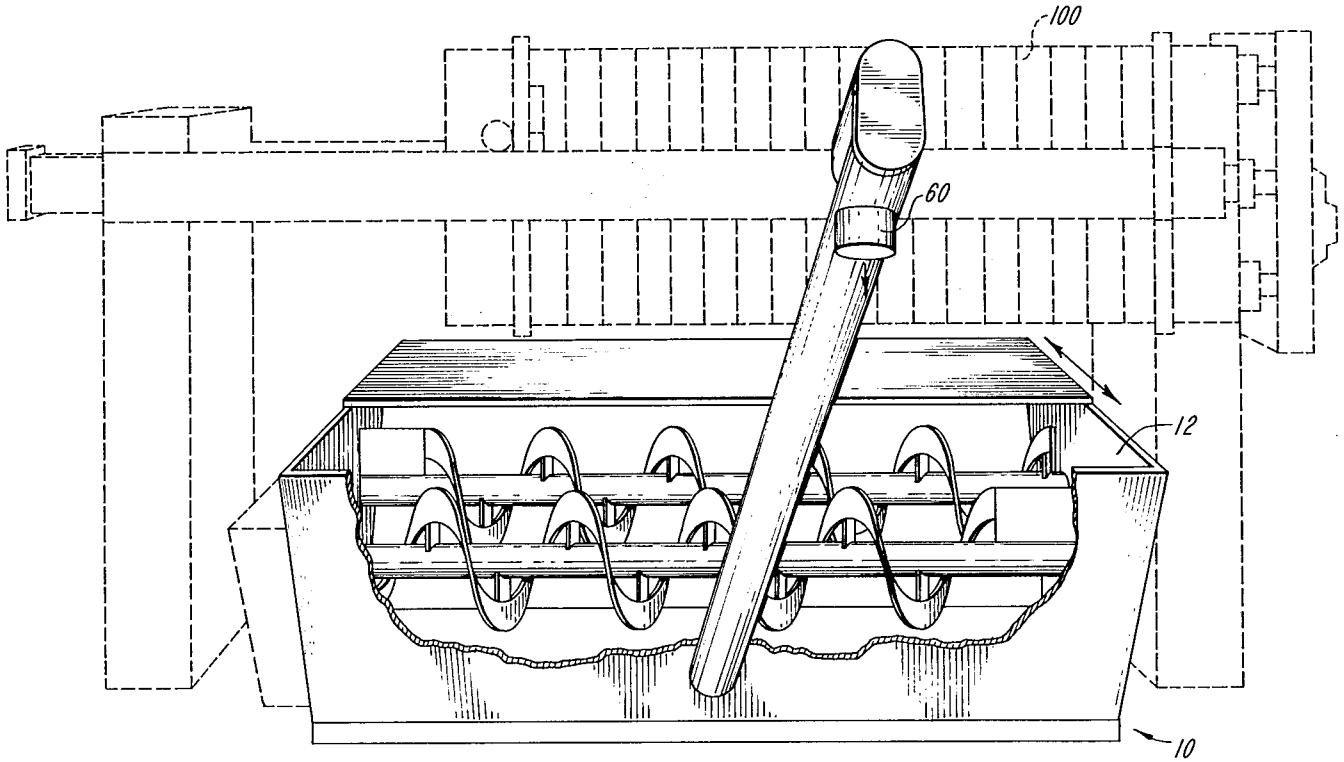
FIG. 3 is a front view thereof.

The trough 12 of the preferred embodiment has a width of approximately 70 inches and a height of approximately 25 inches with a front to back dimension of about 36 inches as seen in FIG. 2. The trough is preferably made of stainless steel such as 3/16 inch thick type 304 stainless steel. The trough has a flat bottom 16 as best seen in FIG. 2 on the underside of which is mounted a plurality of elongated, parallel contact type electric heaters 15 such as chromlox heaters. The heaters extend from side to side of the trough in the area underlying the augers to provide a heated surface 16 which forms the bottom of the trough. Since elongated heaters are used, they can cover a substantial portion of the preferably flat bottom 16, to provide substantially uniform temperature throughout the bottom. The trough bottom 16 angles upward at front 17 and rear 18 with suitably mounted frame members 19 providing support and upper rims 20, 21. The rims 20, 21 can be angled iron pieces extending rearwardly to form a track for a sheet metal cover 13 mounted thereon. Side walls 83 and 84 are formed sections joined to bottom 16, front 17 and rear 18 to form the trough. A bottom safety plate 19 encloses the electric heaters 15. The cover 13 is movable from the open position shown in FIG. 1 to a closed position overlying the top 22 of the trough which is otherwise open.

The cover 13 slides on the guide rails formed by angle irons 20 and 21 reciprocally. A set of switches 23 and 24 are provided at the front edge of the machine which are tripped by closing of the cover 13. These act as safety switches and are connected to cut off all motion of the augers unless they are both tripped as when the cover is closed. The standard position type micro switches can be used as known in the art.

The trough 11 has a sludge capacity capable of handling 6 cubic feet of sludge obtained from waste water treatment as for example having a solids content of up to 30 percent solids.

The cover 13 can be manipulated by hand to the opened or closed position and is preferably fitted with a vent funnel shaped opening 30 at its rear to which is connected a dust aerator collector and air filter 31. A suitable air filter can be a model 1-120-21 collector obtained from Dust Vent, Inc. of Addison, Ill. having dimensions of 23 inches by 23 inches by 28 inches and having a dust catching capacity of 0.76 at a flow rate of 9.5 at 1,000 CFM minimum. The collector can be activated when the cover 13 is closed to remove dust and air from the area providing a constant flow with the dust particles are picked up in a bag of the aerator.

The augers 32 and 33 are preferably ribbon flighted augers each having a kicker panel so as to enable a closed loop path of travel to be formed for movement of the sludge. Closed loop traveling sludge can move in the direction of arrows 40, 41, 42 and 43. In the preferred embodiment, each auger 32 and 33 is 12 inches by 2 inches by 12 inch pitch ribbon flighted 5 foot 8 inches long with a right hand of stainless steel ribbon screw mounted on a 2 ½ inch pipe fitted with 4¼ inch long by ¾ inch by ¼ inch kicker plates and with ¼ turn long left hand kicker flight. The augers are run by a motor drive 50 through a drive chain 51 attached to gears 53, 54 best seen in FIG. 2. Suitable mountings 55, 56, 57, 58 provide bearings in the trough and parallel mount the augers to provide for the closed loop path of travel of the material to be treated.

A hole 62 is provided in a front wall of the trough under which is mounted a removal auger 14 which collects dried materials from the trough moving the material to a forward discharge port 60 supported by a stand bar 61, to enable barrels to be located under the port 60 for filling.

The auger 14 has a surrounding shaft tilted at an angle of approximately 45 degrees to raise the dried sludge from the floor and enable it to be packaged in barrels with a minimum of handling.

The sludge drier 10 is mounted on a suitable frame as by channel or angle irons such as 82 and can be provided with rollers not shown to be easily movable about a floor area.

While a specific embodiment has been shown and described, many modifications are possible. The sludge capacity could be increased with increased size units. All dimensions can be varied to accommodate different sludge load capacities. Stainless steel is preferred although not reguired in all cases. The remote dust collector can be a fabric bag type filter with blowers of 250 CFM for removing 5 micron particle size particles or other types of dust. Other types and sizes of collectors can be used if desired. The auger motor used can vary as known in the art with standard 230/460 volt 3 phase 60HZ service preferred. The heaters preferably provide a temperature of from 400° F. to 275° F. on the trough surface. Preferably up to 20 watts per sguare inch area is provided by the heated surface of the trough which acts as a treating surface. Gas, steam or other heat can be used to heat the surface of trough 12. However, higher or lower temperatures can be used and in some cases gas heaters can be used if preferred.

The augers are preferably ribbon flighted auger screws with kicker panels since they not only convey the materials around the closed loop path of the heated surface but also dig through the cakes that may be positioned in the machine from a filter press or the like so that a cutting and mixing action as well as a conveying action occurs.

In the preferred embodiment, treatment times of from 2 to 8 hours at temperatures of 150° F. to 275° F. can be used to treat from 2 to 25 cubic feet of material so as to provide 70 percent or better solids from material originally having less than 30 percent solids. This results in advantageous volume reduction. The height of the unit allows it to be placed under conventional filter presses and remove material from the filter presses by gravity dropping without material handling eguipment being needed and without significantly elevating the filter press.

The shape of the trough can vary greatly but in all cases, a closed loop path of sludge movement is provided about a heated surface. The surface is preferably substantially flat although it may vary to conform to the flights of the auger in some cases. By providing the closed loop, continuous recirculation is possible.

In a typical operation of the sludge drier of this invention, the sludge drier 10 is installed beneath a filter press as diagrammaticaly shown at 100. An operator begins the operation at the completion of the filter press cycle. The cover of the drier is slid rearwardly exposing the drying chamber through a top opening. The operator then opens the filter press allowing the sludge to drop directly into the drying chamber. No additional handling or transporting of containers of sludge to remote locations is reguired. The operator can then close the cover to the sludge drier, engaging the safety switch which allows the unit to operate.

The operator initiates the drying cycle by pushing a single control as on a control panel, not shown, where the unit activates to heat the electric heaters and start the augers running for a preset period of time. Starting the drying cycle can be made to operate so that the augers run automatically when the electric heaters are switched on. The blower unit to collect dust is started simultaneously.

The counter rotating design of the screws cause the material to be conveyed along one screw to the end where a thrower or kicker panel transfers the material to the second screw. The second screw then conveys the material in the opposite direction to the other end of the drier where it is returned to the first screw forming a continuous recirculating material flow pattern or loop. The design of the screws cause the material to be mixed, broken up, turned and continuously exposing new material to the heated zone at the bottom of the trough.

Heat is provided by the series of electric resistant heater stips securely bolted to the bottom of the sludge drying pan or trough thereby heating the bottom surface of the drier. The material contact with the bottom surface is heated to liberate moisture. The combination of conveying, circulating and blending actions of the transport system then carries the material to the surface where the moisture is liberated to the air passing over the sludge bed. When the unit reaches the end of its preset drying cycle time, the screws, heaters and dust collector are shut off. A light can be used on an operator control panel (not shown) notifying the operator that the drying cycle is completed.

The blower unit then draws air from under the edge of the cover across the sludge drier and out through an exhaust port withdrawing the moisture laden air. A dust collector to trap any particular matter is perferably a part of the blower exhaust system as previously described.

The unit is now ready to be discharged. The operator initiates the cycle by sliding the slide gate 62A covering the opening 62 to the open position and a single control switch is used to operate the removal auger 14. The operator puts the container such as a drum for final disposal of the sludge under the discharge port to the conveying screw. Engaging the discharged cycle switch causes the discharge screw to be started as well as the screws within the drying chamber. As the conveying and blending screws within the chamber carry the material past the discharge port, the material is pushed and drops down onto the flights of the conveying screw which in turn carries it up to the dischargeed spout 60. At the end of a preset time period the cycle is completed. The screws in the drying chamber and discharged screw are shut down.

Of course other means for removing the dried particle from the chamber can be used. For example, the entire trough can be mounted on pivots and hinged to drop down and open into an underlying bin. An opening can be provided in either end of the trough and material removed manually. Various dumping procedures can be used.

In all cases, minimzed floor space can be obtained since the unit can be operated entirely under the filter press if desired. Alternately it can be rolled to the side of the filter press after filling. Sludge volume can be reduced by a substantial percentage, saving on disposal cost. Minimal operator time is reguired. Safety switches are provided to prevent operation of the machine except with the cover closed. There is minimum exposure to hazardous waste since handling is substantially eliminated. The life of the eguipment can be long since it can be made of rugged, durable construction with all stainless steel parts exposed to the sludge. Various automatic temperature controls and separate feedback loops can be used as known in the art. Sealed bearings and the like are preferably used.

I claim:

1. A sludge drier useful for removing water from sludge obtained from wastewater treatment, said sludge drier comprising, a plurality of augers having axes parallel to each other and functionally interconnected to provide a continous closed loop path of movement to said sludge through an area for drying to provide for recirculation of said sludge about said loop during said drying, a heated surface positioned near said augers and lying in said path of movement of said sludge to provide heat to said sludge to remove water therefrom as said sludge moves over said path, means for removing moisture from said area, and means for removing sludge from said sludge drier after drying is carried out.

2. A sludge drier in accordance with claim 1 wherein said auger is comprised a plurality of augers having axes parallel to each other with kicker panels on said augers to form said continuous closed loop path of movement.

3. A sludge drier in accordance with claim 2 and further comprising said heated surface underlying said augers with said augers lying substantially on a horizontal plane.

4. A sludge dryer in accordance with claim 3 and further comprising said heated surface being formed by a portion of a trough for receiving sludge, said trough mounting said augers and defining an opening above said augers for introducing sludge from a filter press directly into said trough.

5. A sludge drier in accordance with claim 4 wherein said opening is covered by a removable cover.

6. A sludge drier in accordance with claim 5 wherein said cover comprises safety switch means for preventing movement of said augers when said cover is in an open position.

7. A sludge drier in accordance with claim 6 and further comprising said means for removing comprising a removal auger positioned to receive dried sludge from said path of travel after drying is accomplished and to remove said dried sludge for disposal.

8. A sludge drier in accordance with claim 7 wherein said means for removing moisture comprises an air removal means interconnected with a dust collector for removing moisture laden air from an area above said sludge within said trough.

9. A sludge drier in accordance with claim 2 wherein said augers are each ribbon flighted auger screws each having a kicker panel.

10. A sludge drier in accordance with claim 9 wherein said heated surface is heated by contact heaters mounted on a bottom of said surface and providing heat to the said surface exposed to said sludge.

11. A sludge drier in accordance with claim 10 wherein said sludge drier has a height designed to enable it to be positioned below a filter press to receive material from said filter press after use of the filter press whereby sludge may be deposited directly by gravity into said sludge drier and removed by said means for removal, without additional material handling equipment.

12. A method for drying sludge obtained from a filter press, said method comprising, introducing sludge obtained from a filter press into a trough having a heated surface over which is positioned at least two parallel substantially side by side augers in a relationship, each having a kicker panel to form a closed loop path of travel for said sludge over said heated surface, activating said augers to cause said sludge to move within a path of travel with said sluger having a high moisture content with up to 30 percent solids and moving said sludge over said heated surface in a continuous closed loop at a temperature in the range of from about 150° F. to about 400° F. for a period of time of from about 2 to about 8 hours as may be sufficient to obtain a solids content of over 70 percent in said sludge whereupon said sludge is considered to be dried, and removing said sludge from said drier.

13. A method in accordance with claim 12 wherein said sludge is introduced directly from a filter press in a cake form and said sludge is broken up and circulated in said augers which are ribbon flighted augers to provide for movement over the heated path and also mixing and breaking of any caked material.

14. A method in accordance with the method of claim 13 and further comprising covering said sludge during said heating while permitting activation of said augers only after said cover is in position, and drawing air from said drier using an air flow with fabric type filter bag to remove moisture laden air from said drier.

15. A method in accordance with the method of claim 14 wherein said method is carried out as a batch operation.

16. In a sludge drier for removing water from sludge obtained from wastwater treatment, which sludge drier defines a path of movement of said sludge over a heated surface and has means for removing moistue laden air from said drier, the improvement comprising, providing a plurality of side by side parallel augers with means for permitting movement of sludge in a closed loop between said augers whereupon sludge can be moved in a continuous closed loop over said heated surface for a sufficient period of time to permit drying thereof, and means for discharging said sludge after drying thereof.

17. The improvement of claim 16 wherein said augers are two in number and are substantially horizontally located in side by side relationship within an open trough having an area such that drying of sludge to a level of at least 70% by weight solids, is substantially accomplished in time periods of up to eight hours.

* * * * *